US006578290B1

(12) United States Patent
Meynard

(10) Patent No.: US 6,578,290 B1
(45) Date of Patent: Jun. 17, 2003

(54) SHOE SOLE

(75) Inventor: Michel Meynard, Framingham, MA (US)

(73) Assignee: Meynard Designs, Inc., Framingham, MA (US)

( * ) Notice: Subject to any disclaimer, the term of this patent is extended or adjusted under 35 U.S.C. 154(b) by 0 days.

(21) Appl. No.: 09/982,181

(22) Filed: Oct. 17, 2001

(51) Int. Cl.[7] ..... A43B 13/14
(52) U.S. Cl. ..... 36/103; 36/25 R
(58) Field of Search ..... 36/103, 25 R, 36/28, 142–144, 68, 80

(56) References Cited

U.S. PATENT DOCUMENTS 3,964,181 A * 6/1976 Holcombe, Jr. ..... 36/25 R
4,934,073 A * 6/1990 Robinson ..... 36/25 R
5,491,912 A * 2/1996 Snabb et al. ..... 36/25 R
5,598,645 A * 2/1997 Kaiser ..... 36/28
5,771,606 A * 6/1998 Litchfield et al. ..... 36/28

FOREIGN PATENT DOCUMENTS

WO 91/11124 * 8/1991

* cited by examiner

*Primary Examiner*—Ted Kavanaugh
(74) *Attorney, Agent, or Firm*—Wolf, Greenfield & Sacks, P.C.

(57) ABSTRACT

A shoe construction having a sole in which the upper surface of the sole when in normal use on a flat surface is lower at the heel bed than at the foresole portion of the shoe. Canting of the upper sole surface in a downward direction at the rear, coupled with upwardly extending sections of the heel at the rear counter, provides cradle-like surface. The peripheral edge of the sole extends upwardly over the upper surface around at least a substantial portion of its periphery and, in particular, at the rear counter where the upper periphery of the rear counter extends substantially higher than the lower most portion of the upper surface in the heel region of the sole.

7 Claims, 2 Drawing Sheets

SHOE SOLE

SUBJECT MATTER OF THE INVENTION

The present invention relates to footwear and in particular to footwear having a sole construction in which the upper surface of the sole, when in normal use, is lower at the heel bed than at the foresole portion of the sole construction.

BACKGROUND OF INVENTION

For some time shoe or footwear soles having a construction in which the fore portion of the sole is higher than the heel portion of the sole, have been promoted as having certain physical and orthopedic advantages. Footwear made with such lower heel beds require a person using such soles lean slightly forward for proper balance. When the heel bed is lower than the foresole, there is a tendency of the foot to slide rearwardly towards the heel. Accordingly, there is a need to provide this type of sole structure with means for properly cradling the foot on the sole for normal and comfortable use.

Previous attempts to provide soles in which the heel has a negative cant in respect to the foresole have been disclosed. These earlier efforts to provide a structure of this type have concerned themselves primarily with the inclination of the sole and have not been particularly concerned with properly nesting the foot.

SUBJECT MATTER OF PRESENT INVENTION

The present invention is directed to a shoe construction having a shoe sole in which the upper surface of the sole is canted downwardly from the foresole to the heel bed when the sole bottom rests on a level surface. This construction in combination with means providing a foot cradle extending substantially upwardly around the heel at the rear counter assures the wearer his foot is properly cradled and undesired rearward movement of the foot relative to the sole when the footwear is in use is prevented.

It is a further object of the present invention to provide a shoe sole having an upper surface in which the surface of the sole at the heel is normally lower than the surface of the sole at the foresole and the instep region. In this arrangement the upper surface of the sole is essentially canted rearwardly and downwardly. The sole is further provided with a peripheral edge that extends upwardly over the upper surface around at least a substantial portion of its periphery and in particular, at the rear counter where the upper periphery of the rear counter extends substantially higher than the lower most portion of the upper surface in the heel region of the sole.

BRIEF DESCRIPTION OF DRAWINGS

The foregoing objects and advantages of the present invention will be more clearly understood when considered in connection with a description of preferred embodiments of the invention in association with the drawings in which.

DETAILED DESCRIPTION OF THE PREFERRED EMBODIMENT

In the preferred embodiment illustrated, a shoe construction 10 includes a shoe upper shown in dotted that is conventionally secured to the upper periphery of a shoe sole 14. The shoe upper 12 may be formed in any satisfactory fashion using conventional styling techniques. In one embodiment the shoe upper may comprise a low cut leather upper of conventional design or styling. In the embodiment suggested by the shoe upper 12 the upper is a low cut upper but if desired shoe uppers of different styles including, high-cut uppers may be included. Additionally, the upper of the present invention contemplates the use of a sandal style upper in which the foot is not entirely engaged above the sole by the upper. In this particular design, the configuration of the shoe sole 14 becomes more relevant and has greater utility. In many cases the upper is made of leather, plastic, fabric, or a combination. For the most part, the upper provides limited support to the bottom of the foot.

Figure 1:
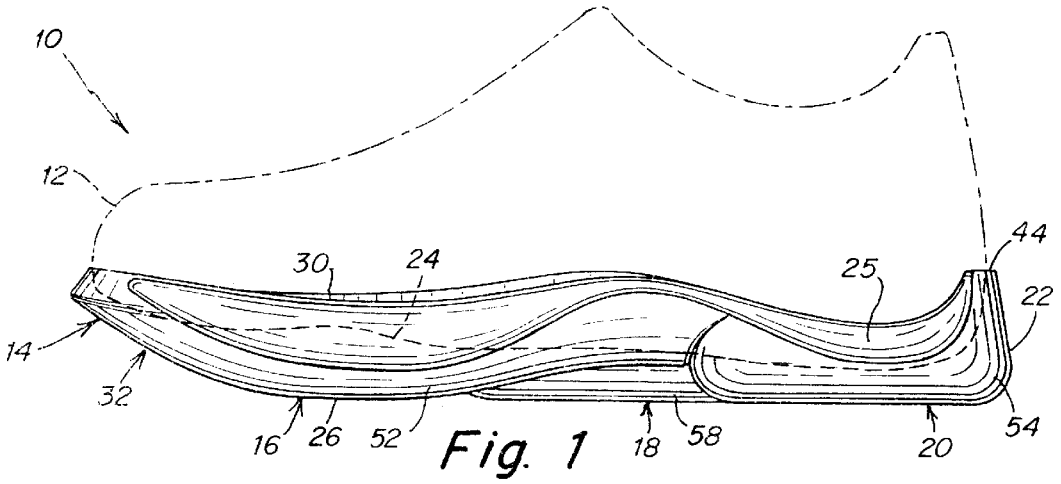
FIG. 1 is a medial side elevational view of a shoe sole embodying the present invention with the location of the shoe upper shown in dotted outline.
Figure 2:
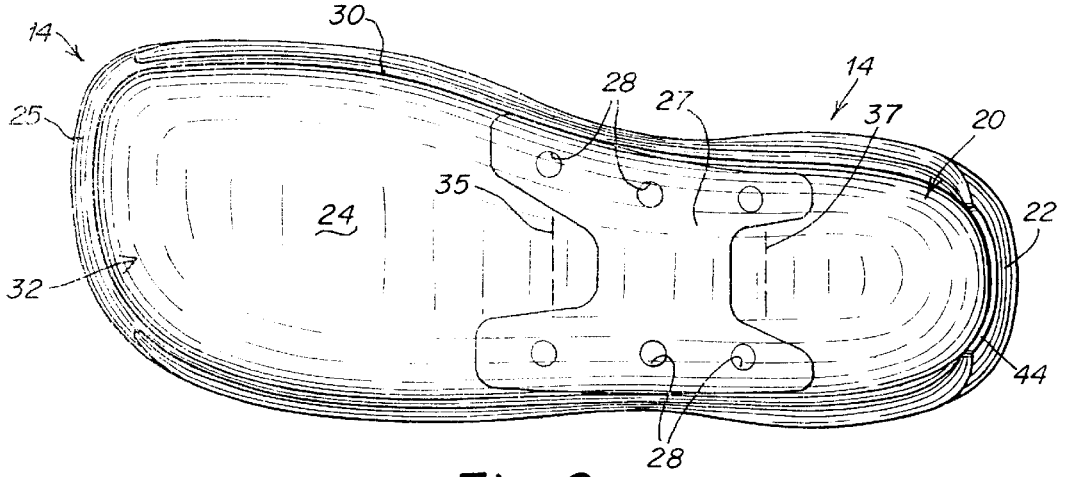
FIG. 2 is a top plan view of the embodiment of FIG. 1.
Figure 3:
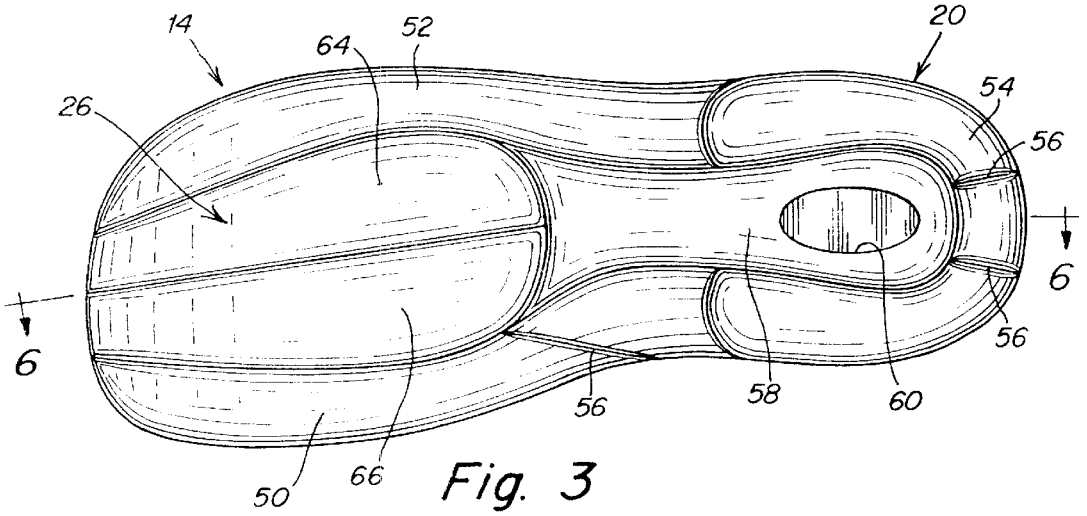
FIG. 3 is a bottom-plan view of the embodiment of FIG. 1.

The shoe sole 14 includes a foresole region 16, an instep region 18, and a heel region 20 with a rear counter 22. These portions of the shoe sole 14 are integrally formed one with the other. The shoe sole 14 may be injection molded of a suitable polymer material in a conventional fashion and may comprise, for example, an injection molded plastic or other equivalent materials conventionally used for shoe sole construction. The shoe sole 14 is formed as an integral unit with an upper surface 24 and a lower surface 26 joined together by a sidewall 25, which extends about the entire periphery of the shoe sole. The sole 14 may be integrally formed of a single material of desired density. It may also be provided with an instep insert 27 integrally molded with the remainder of the shoe sole 14 with this instep insert having a different density of durometer than the remaining portion of the shoe sole to provide added or different stiffness from the remainder of the shoe sole. The inset may take a variety of forms. As illustrated in FIG. 2, the insert 27 has an "H " like configuration with a plurality of openings 28 formed in it through which the material forming the remaining portion of the shoe sole 14 may flow on molding for greater and more intimate inter-engagement with the main body of the sole.

The upper surface 24 has an upper-periphery 30 that defines the upper surface 24. The upper surface 24 may be conventionally shaped to receive a foot and may be selectively sized with different units having conventionally different dimensions for various foot sizes. The periphery 30 of the upper may be divided into three portions including the foresole portion 16, which extends from the toe region 32 to the junction of the instep region 18 at approximately the line 35 (FIG. 2) the instep region extends from line 35 rearwardly to approximately the line 37, which defines the heel or heel bed 20.

The periphery of the sole is essentially defined by the side-wall 25, which may be selectively contoured and varied in width as illustrated in the drawings with the side-wall 25 extending around the medial front and lateral sides of the shoe and terminating at the rear counter 22 with the side-walls extending upwardly at the rear counter to the upper-periphery 44 of the rear counter. As illustrated in the drawings, the sidewall 25 is narrowest at the instep. The sidewall 25 has an upper edge that is highest at the instep region and lowest at the heel 20. The sidewall 25 is widest at the foresole 16. The narrowing of the sidewall 25 at the instep region may provide some greater flexibility for flexing the sole while walking.

The sidewall 25 may be variably formed but in the preferred embodiment is contoured to provide a visually enhanced appearance and selective structural advantages. In the preferred embodiment illustrated the surface contours of the lower surface 26 include a series of semi-cylindrical elongated shapes arranged side by side with medial semi-cylindrical shape 50 extending from the toe region rearwardly to the heel 20 and with a lateral semi-cylinder 52 also extending from the toe region rearwardly to the heel 20. A semi-cylinder 54 extends around the periphery of and defines the heel 20 with this semi-cylinder 54 extending to the heel ends of the semi-cylinders 50 and 52 a series of transverse wedged shape cuts 56 may be formed in the semi-cylinder 54 and 50 for enhanced flexibility. A semi-cylinder 58 is formed in the heel and instep region filling the space between the cylinders 56, 52, and 54. The semi-cylinder 58 may be provided with a recess 60 that is shaped, sized, and dimensioned to receive a trademark escutcheon. A pair of semi-cylinders 64 and 66 positioned side by side extends from the end of the cylinder 58 forwardly to the toe region and fills the space between the cylinders 50 and 52.

Figure 4:
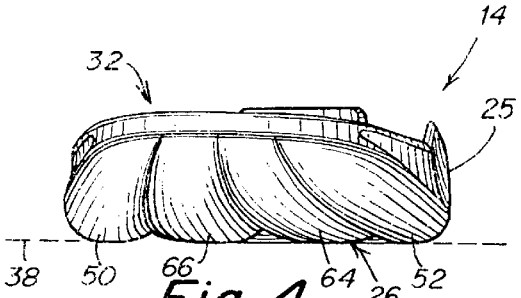
FIG. 4 is a front-elevational view thereof.
Figure 5:
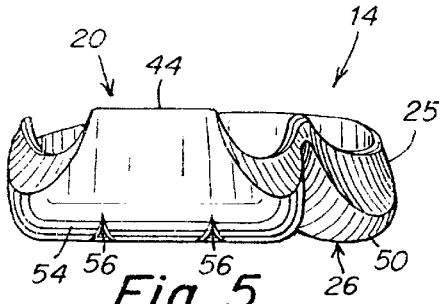
FIG. 5 is a rear-elevation view thereof.
Figure 6:
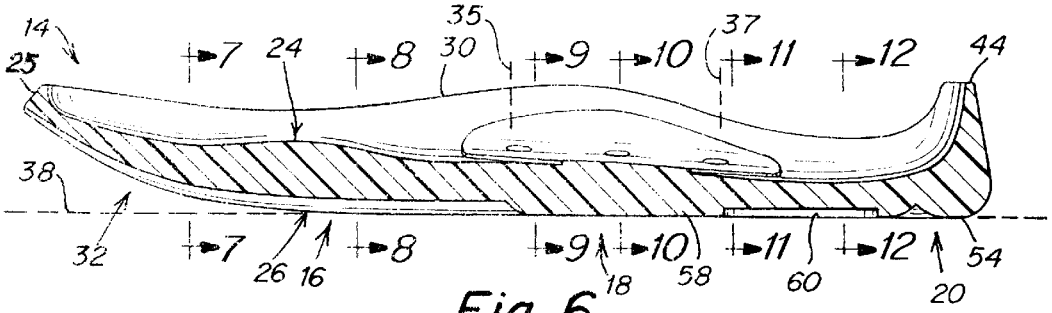
FIG. 6 is a cross-sectional side view taken substantially along the line 6—6 of FIG. 3, which in turn is essentially a medial cross-sectional view taken lengthwise of the shoe sole.
Figure 7:
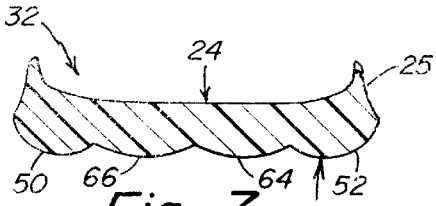
FIG. 7 is a transverse cross-sectional view taken along line 7—7 of FIG. 6.
Figure 8:
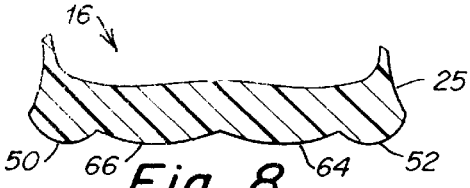
FIG. 8 is a transverse cross-sectional view taken along the line 8—8 of FIG. 6.
Figure 9:
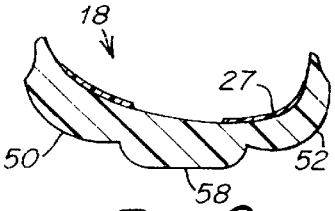
FIG. 9 is a transverse cross-sectional view taken along the line 9—9 of FIG. 6.
Figure 10:
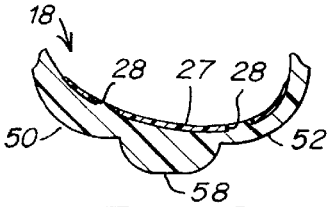
FIG. 10 is a transverse cross-sectional view taken along the line 10—10 of FIG. 6.
Figure 11:
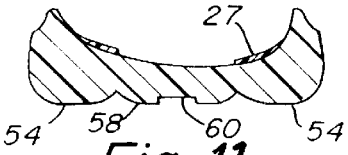
FIG. 11 is a transverse cross-sectional view taken along the line 11—11 of FIG. 6.
Figure 12:
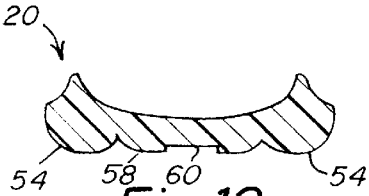
FIG. 12 is transverse cross-sectional view taken along the line 12—12 of FIG. 6.

As illustrated in FIGS. 7 through 12, when the lower surface 26 engages a flat surface 38 selective portions of the sole normally rest on the flat surface 38. In this arrangement, as best illustrated in FIGS. 4 and 6, the lowermost portions of the various semi-cylinders engage the flat surface 38 with the forward portion of the cylinders 64 and 66 extending upwardly at the foremost portion of the sole and also, at the outer edges of the cylinders 52, 54 and 56. Relevant contours of the upper surface 24 and lower surface 26 in relation to the flat surface 38 define height distances of various portions of the upper from the flat surface 38. In a preferred embodiment ratios of various heights of the upper surface 24 from the flat surface 38 are best illustrated in FIG. 6. In a typical preferred embodiment the distance between the flat surface 38 and respective positions on the upper surface 24 are as follows: at the highest position of the upper periphery at the rear counter 44, 41 millimeters; at the lower portion in the heel at approximately the cross-sectional position of FIG. 12, 10.5 millimeters; at the heel region at approximately the cross-sectional view of FIG. 11, 11 millimeters; at the instep region at the approximate cross-sectional position of FIG. 10, 13 millimeters; at the cross-sectional position of FIG. 9 in the instep region, about 12.5 millimeters; at the crosssectional position in the foresole region at approximately FIG. 8, approximately 19 millimeters; at a position halfway between the cross-sectional views of FIGS. 7 and 8, approximately 21 millimeters; and, at the cross-sectional position in the foresole at FIG. 7, approximately 20 millimeters. These heights, on the medial position, may vary as illustrated in the lateral dimension as shown in FIGS. 7 through 12 from the medial measurement as indicated above. Thus, it will be noted that the lower portion of the height from the flat-surface 38 occurs at the heel bed 20 just forward of the rear-counter with the high portion occurring between the cross-sectional views 7 and 8. It will be noted that the relative curvature and height of the upper surface 24 is more curved in the instep region 18 as illustrated in FIGS. 9 and 10 than in the heel 20 as illustrated in FIGS. 11 and 12, and much more so in the foresole regions as shown in FIGS. 7 and 8. The relative height of the upper periphery of the side-wall 25 to the height at the periphery of the upper surface 24 from the flat surface 38 is greater in the instep region 18 than either in the foresole portion 16 or the heel 20 as best illustrated by comparing FIGS. 9 and 10 with FIGS. 7 and 8 in the forepart region and FIG. 11 and FIG. 12 in the heel. Thus, for example, the maximum height on the periphery 25 at the instep region is in the order of 37.5 millimeters whereas the relative maximum height in the foresole is in the order of 30 millimeters and in the heel in the order of 24.5 millimeters.

Thus comparing the height distances from the upper surfaces of the sole to flat surface or common resting surface 38, the heel is in the order of 55% of the height at the foresole and the instep is in the order of 65% of the foresole.

Having now described my invention I claim:

1. A shoe sole construction to which a shoe upper is secured, said sole having an integrally formed foresole, instep region, heel and rear counter, with continuous integral upper and lower surfaces defining the sole as an integral unit, said sole, when positioned with its lower surface resting on a flat surface having a height at the mid-center line of the sole between the upper surface and the flat surface greater at the foresole than the heel, said rear counter extending upwardly to form a cradle for a heel of a foot resting on the sole, with the upper periphery of the rear counter from said flat surface having a maximum height above said flat surface that is in the order of at least twice said height at said foresole and with a height distance in said foresole greater at the center portion thereof than at both the forward and rear ends thereof.

2. A construction as set forth in claim 1 wherein a shoe upper is secured to the upper surface of the sole at the periphery thereof.

3. A shoe sole as set forth in claim 1 wherein the height distance from the upper surface of the sole at said heel to a common resting surface is in the order of 55% of the height distance at said foresole to the common resting surface.

4. A shoe sole as set forth in claim 1 wherein the height distance from the upper surface of the sole at the instep region to a common resting surface is in the order of 65% of the height distance at the foresole to the common resting surface.

5. A shoe sole as set forth in claim 3 wherein the height distance from the upper surface of the sole at the instep region to a common resting surface is in the order of 65% of the height distance at the foresole to the common resting surface.

6. A shoe sole construction to which a shoe upper is secured, said sole having an integrally formed foresole, instep region, heel and rear counter, with continuous integral upper and lower surfaces defining the sole as an integral unit, said sole, when positioned with its lower surface resting on a flat surface having a height at the mid-center line of the sole between the upper surface and the flat surface greater at the foresole than the heel, and with said rear counter extending upwardly to form a cradle for a heel of a foot resting on the sole, with the upper periphery of the rear counter having a maximum height above said flat surface that is in the order of at least three times said height at said heel and with a height distance in said foresole greater at the center portion thereof than at both the forward and rear ends thereof.

7. A shoe sole as set forth in claim 6 wherein said height of said rear counter above said flat surface is in the order of four times said height at said heel.

* * * * *